US011846903B2

(12) United States Patent
Inoue et al.

(10) Patent No.: US 11,846,903 B2
(45) Date of Patent: Dec. 19, 2023

(54) BELT DEVICE, FIXING DEVICE, AND IMAGE FORMING APPARATUS

(71) Applicants: Daisuke Inoue, Tokyo (JP); Yuusuke Furuichi, Kanagawa (JP); Hiroyuki Shimada, Tokyo (JP); Yukimichi Someya, Saitama (JP); Satoshi Tohkai, Kanagawa (JP); Yumiko Hayashi, Kanagawa (JP)

(72) Inventors: Daisuke Inoue, Tokyo (JP); Yuusuke Furuichi, Kanagawa (JP); Hiroyuki Shimada, Tokyo (JP); Yukimichi Someya, Saitama (JP); Satoshi Tohkai, Kanagawa (JP); Yumiko Hayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/742,912

(22) Filed: May 12, 2022

(65) Prior Publication Data

US 2022/0382192 A1 Dec. 1, 2022

(30) Foreign Application Priority Data

Jun. 1, 2021 (JP) ..... 2021-092323

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS

| | | | |
|---|---|---|---|
| 2005/0266325 | A1 | 12/2005 | Yanagawa et al. |
| 2015/0078794 | A1 | 3/2015 | Natori et al. |
| 2020/0249601 | A1 | 8/2020 | Inoue et al. |
| 2020/0292972 | A1 | 9/2020 | Inoue et al. |
| 2020/0292973 | A1 | 9/2020 | Furuichi et al. |

(Continued)

FOREIGN PATENT DOCUMENTS

| | | |
|---|---|---|
| JP | 2005-338222 | 12/2005 |
| JP | 2011-170159 | 9/2011 |

(Continued)

OTHER PUBLICATIONS

JP 2013213904 English translation, Natori et al., Oct. 17, 2013 (Year: 2013).*

*Primary Examiner* — Thomas S Giampaolo, II
(74) *Attorney, Agent, or Firm* — Harness, Dickey & Pierce, P.L.C.

(57) ABSTRACT

A belt device includes a secured member, a belt, a pressure rotator, and lubricant. The belt has an endless shape and slides on a slide surface of the secured member. The belt has an inner portion having an elastic power of 55% or more and a sliding surface sliding on the slide surface of the secured member. The sliding surface has a surface roughness smaller than a surface roughness of the slide surface of the secured member. The pressure rotator presses the secured member via the belt to form a nip between the belt and the pressure rotator. The lubricant is interposed between the sliding surface of the belt and the slide surface of the secured member.

17 Claims, 11 Drawing Sheets

(56) References Cited

U.S. PATENT DOCUMENTS

| | | | | |
|---|---|---|---|---|
| 2020/0401067 | A1 | 12/2020 | Samei et al. | |
| 2020/0409292 | A1* | 12/2020 | Fujimoto ..... | G03G 15/2025 |
| 2021/0157259 | A1 | 5/2021 | Inoue et al. | |
| 2021/0318655 | A1 | 10/2021 | Inoue et al. | |

FOREIGN PATENT DOCUMENTS

| | | |
|---|---|---|
| JP | 2013-213904 | 10/2013 |
| JP | 2014-081470 | 5/2014 |
| JP | 2014-189601 | 10/2014 |
| JP | 2020-148943 | 9/2020 |

* cited by examiner

SURFACE ROUGHNESS OF FIXING BELT > SURFACE ROUGHNESS OF HEATER

SURFACE ROUGHNESS OF FIXING BELT < SURFACE ROUGHNESS OF HEATER $$Sa = \frac{1}{A}\iint_A |Z(x,y)|\,dxdy$$

BELT DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2021-092323, filed on Jun. 1, 2021, in the Japan Patent Office, the entire disclosure of which is incorporated by reference herein.

BACKGROUND

Technical Field

Embodiments of the present disclosure generally relate to a belt device, a fixing device, and an image forming apparatus.

Related Art

As a belt device installed in an image forming apparatus such as a copying machine or a printer, there is a fixing device using an endless belt.

SUMMARY

This specification describes an improved belt device that includes a secured member, a belt, a pressure rotator, and lubricant. The belt has an endless shape and slides on a slide surface of the secured member. The belt has an inner portion having an elastic power of 55% or more and a sliding surface sliding on the slide surface of the secured member. The sliding surface has a surface roughness smaller than a surface roughness of the slide surface of the secured member. The pressure rotator presses the secured member via the belt to form a nip between the belt and the pressure rotator. The lubricant is interposed between the sliding surface of the belt and the slide surface of the secured member.

This specification also describes a fixing device that includes the belt device.

This specification further also describes an image forming apparatus including the belt device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
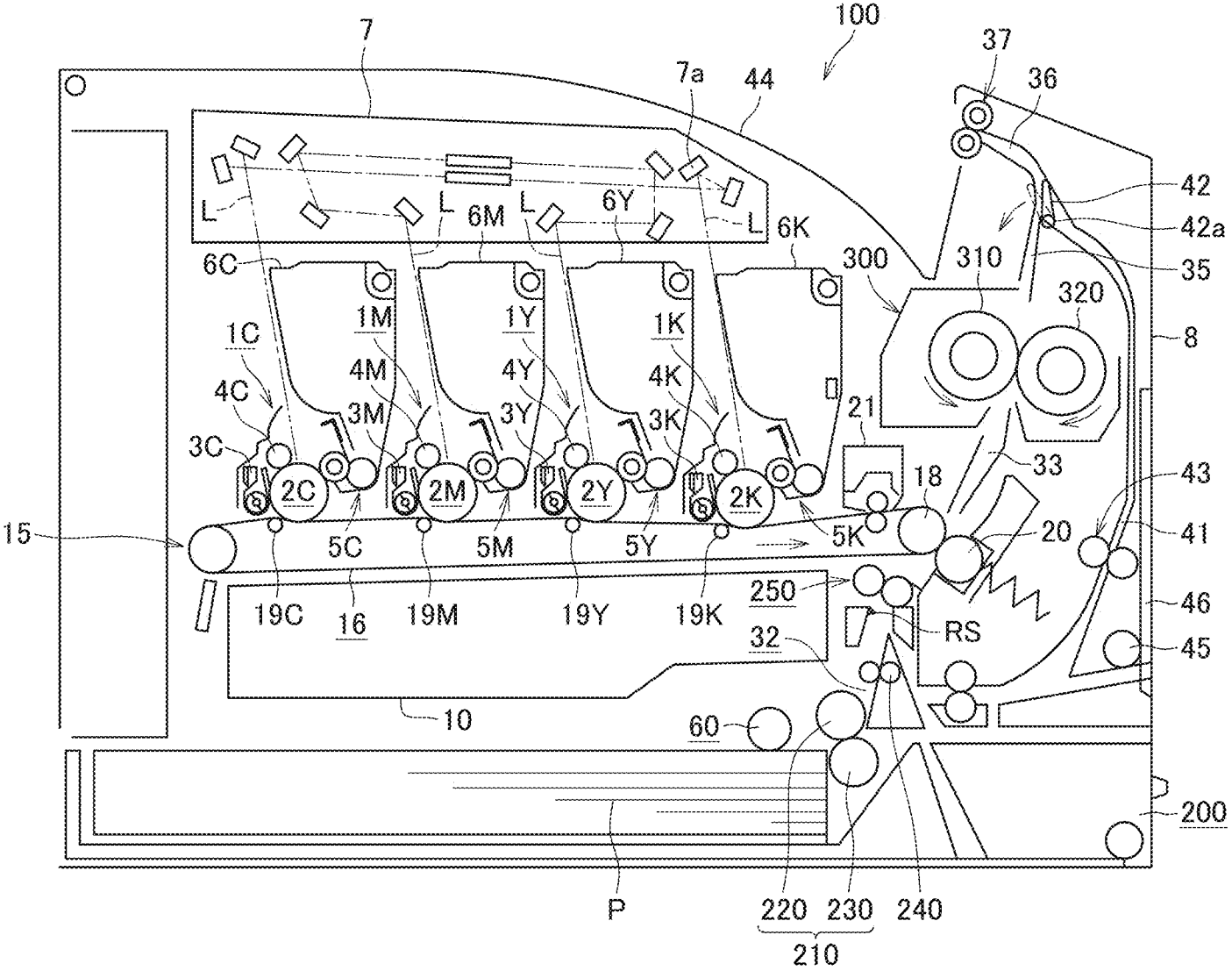
FIG. 1A is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

With reference to drawings, a description is given of a belt device according to embodiments of the present disclosure, a fixing device using the belt device, and an image forming apparatus such as a laser printer using the belt device. The "belt device" in the present disclosure means a device including a rotatable endless belt, a secured member having a slide surface on which the inner surface of the belt slides, a pressure rotator in contact with the secured member via the belt forming a nip between the belt and the pressure rotator, and lubricant interposed between the secured member and the inner surface of the belt. The "fixing device" means a device that conveys a sheet as a recording medium to record an image to the nip between the belt and the pressure rotator and fixes unfixed toner onto the sheet. The "image forming apparatus" means an apparatus that includes the fixing device and applies developer or ink to the sheet to form the image on the sheet.

The laser printer is an example of the image forming apparatus. Therefore, the image forming apparatus of the present disclosure is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

The identical or similar parts in each drawing are designated by the same reference numerals, and the duplicate description thereof is appropriately simplified or omitted. Further, size (dimension), material, shape, and relative positions used to describe each of the components and units are examples, and the scope of the present disclosure is not limited thereto unless otherwise specified.

Although the "recording medium" is described as the "sheet" in the following embodiments, the "recording medium" is not limited to the sheet of paper. Examples of the "recording medium" include not only the sheet of paper but also an overhead projector (OHP) transparency sheet, a fabric, a metallic sheet, a plastic film, and a prepreg sheet including carbon fibers previously impregnated with resin.

Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image forming" used in the following description means not only giving an image having a meaning, such as a character or a figure, to a medium but also giving an arbitrary image having no meaning, such as a pattern, to a medium.

Configuration of Image Forming Apparatus

Figure 1B:
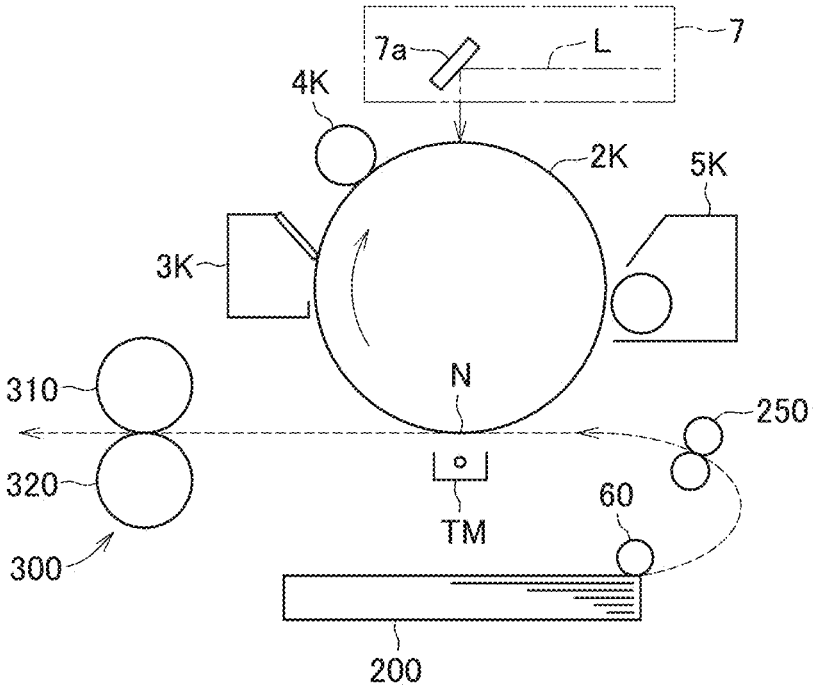
FIG. 1B is a schematic diagram illustrating the principle of how an image forming apparatus operates, according to an embodiment of the present disclosure.

FIG. 1A is a schematic diagram illustrating a configuration of an image forming apparatus 100 (illustrated as a laser printer) including a fixing device 300 that includes the belt device according to an embodiment of the present disclosure. FIG. 1B illustrates the principle of an operation in the laser printer (as the image forming apparatus according to the present embodiment).

The image forming apparatus 100 includes four process units 1K, 1Y, 1M, and 1C as image forming devices. Suffixes, which are K, Y, M, and C, are used to indicate respective colors of toners (black, yellow, magenta, and cyan toners in this example) for the process units. The process units 1K, 1Y, 1M, and 1C form images of color toners of black (K), yellow (Y), magenta (M), and cyan (C) corresponding to color separation components of a color image.

The process units 1K, 1Y, 1M, and 1C respectively include toner bottles 6K, 6Y, 6M, and 6C containing different color toners. The process units 1K, 1Y, 1M, and 1C have a similar structure except the color of toner. Thus, the configuration of the one process unit 1K is described below, and the descriptions of the other process units 1Y, 1M, and 1C are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer and a developing device 5K as a developing unit that performs visible image processing to an electrostatic latent image formed on the image bearer. The process unit 1K is detachably attachable to a main body of the image forming apparatus 100. Consumable parts of the process unit 1K can be replaced at one time.

An exposure device 7 is disposed above the process units 1K, 1Y, 1M, and 1C in the image forming apparatus 100. The exposure device 7 performs writing and scanning based on image data, in other words, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to a transfer unit TM in FIG. 1B. Primary transfer rollers 19K, 19Y, 19M, and 19C are disposed opposite the image bearers 2K, 2Y, 2M, and 2C, respectively, to contact an intermediate transfer belt 16.

The intermediate transfer belt 16 is stretched around and entrained by the primary transfer rollers 19K, 19Y, 19M, and 19C, a drive roller 18, and a driven roller 17 to rotate in a circulating manner. A secondary transfer roller 20 is disposed opposite the drive roller 18 to contact the intermediate transfer belt 16. Note that, when the image bearers 2K, 2Y, 2M, and 2C serve as primary image bearers to bear images of the respective colors, the intermediate transfer belt 16 serves as a secondary image bearer to bear a composite image in which the images on the respective image bearers 2K, 2Y, 2M, and 2C are superimposed one on another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed in a lower portion of the image forming apparatus 100. The sheet feeder 200 serves as a recording-medium supply device and can store a bundle of a large number of sheets P as recording media. The sheet feeder 200 is integrated as a single unit together with a sheet feed roller 60 and a roller pair 210 as a conveyor for the sheets P.

The sheet feeder 200 is detachably inserted in the main body of the image forming apparatus 100 to supply the sheet. The sheet feed roller 60 and the roller pair 210 are disposed at an upper portion of the sheet feeder 200 and convey the uppermost one of the sheets P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading end of the sheet P and corrects a skew of the sheet P.

A registration sensor RS is disposed immediately upstream from the registration roller pair 250 in the sheet conveyance direction and detects passage of a leading end of the sheet. When a predetermined time passes after the registration sensor RS detects the passage of the leading end of the sheet, the sheet contacts the registration roller pair 250 and temporarily stops.

Conveyance rollers 240 are disposed downstream from the sheet feeder 200 to convey the sheet conveyed to the right side from the roller pair 210 upward. As illustrated in FIG. 1A, the conveyance rollers 240 convey the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied with a certain amount of torque in a counter sheet feeding direction from a driving shaft via a torque limiter and pressed against a feed roller to separate sheets in a nip between the separation roller and the feed roller. In the FR separation system, the separation roller (a friction roller) is supported by a secured shaft via a torque limiter and pressed against a feed roller to separate sheets in a nip between the separation roller and the feed roller.

The roller pair 210 in the present embodiment is configured as the FRR separation system. That is, the roller pair 210 includes a feed roller 220 and a separation roller 230. The feed roller 220 is an upper roller of the roller pair 210 and conveys a sheet toward an inner side of the image forming apparatus 100. The separation roller 230 is a lower roller of the roller pair 210. A driving force acting in a direction opposite a direction in which a driving force is given to the feed roller 220 is given to the separation roller 230 by a drive shaft through a torque limiter.

The separation roller 230 is pressed against the feed roller 220 by a biasing member such as a spring. A clutch transmits the driving force of the feed roller 220 to the sheet feed roller 60. Thus, the sheet feed roller 60 rotates counterclockwise in FIG. 1A.

The registration roller pair 250 feeds the sheet P, which has contacted the registration roller pair 250, toward a secondary transfer nip between the secondary transfer roller 20 and the drive roller 18, which is illustrated as a transfer nip N in FIG. 1B, at a suitable timing to transfer a toner image on the intermediate transfer belt 16 onto the sheet P. A bias applied at the secondary transfer nip electrostatically transfers the toner image formed on the intermediate transfer belt 16 onto the fed sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33.

The fixing device 300 includes a fixing belt 310 that is an endless belt and a pressure roller 320 as a pressure rotator that rotates while pressing against the fixing belt 310 with a predetermined pressure.

A post-fixing conveyance path 35 is disposed above the fixing device 300 and branches into a sheet ejection path 36 and a reverse conveyance path 41 at the upper end of the post-fixing conveyance path 35. At this branching portion, a switching member 42 is disposed and pivots on a pivot shaft 42*a*. At an opening end of the sheet ejection path 36, a pair of sheet ejection rollers 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as a sheet ejection tray 44.

A powder container 10 such as a toner container is disposed between the transfer device 15 and the sheet feeder 200. The powder container 10 is removably installed in the apparatus body of the image forming apparatus 100.

Suitable sheet conveyance in the image forming apparatus 100 according to the present embodiment needs a predetermined length from the sheet feed roller 60 to the secondary transfer roller 20. The powder container 10 is disposed in a dead space caused by that distance to keep the entire image forming apparatus compact.

A transfer cover 8 is disposed above the sheet feeder 200 and on a front side in a direction to which the sheet feeder 200 is pulled out. The transfer cover 8 can be opened to check an interior of the image forming apparatus 100. The transfer cover 8 includes a bypass feed roller 45 for bypass sheet feeding and a bypass feeder 46 for the bypass sheet feeding.

Operation of Image Forming Apparatus

Next, a basic operation of the image forming apparatus (illustrated as the laser printer) according to the present embodiment is described below with reference to FIG. 1A. First, operations of a simplex or single-sided printing are described.

The sheet feed roller 60 rotates according to a sheet feeding signal from a controller of the image forming apparatus 100. The sheet feed roller 60 separates the uppermost sheet from a bundle of sheets P (also referred to as a sheet bundle) loaded in the sheet feeder 200 and feeds the uppermost sheet to the sheet feeding path 32.

When the leading edge of the sheet P, which has been fed by the sheet feed roller 60 and the roller pair 210, reaches a nip of the registration roller pair 250, the sheet P is slackened and temporarily stopped by the registration roller pair 250. The registration roller pair 250 corrects the skew on the leading-edge side of the sheet P and rotates in synchronization with an optimum timing so that a toner image formed on the intermediate transfer belt 16 is transferred onto the sheet P.

In the case that the sheet P is fed from the bypass feeder 46, sheets P of the sheet bundle loaded on the bypass feeder 46 are fed one by one from the uppermost sheet of the sheet bundle by the bypass feed roller 45. Then, the sheet P passes a part of the reverse conveyance path 41 and is conveyed to the nip of the registration roller pair 250. The subsequent operations are the same as the sheet feeding operations from the sheet feeder 200.

As to image formation, operations of the process unit 1K are described as representative, and descriptions of the other process units 1Y, 1M, and 1C are omitted here. First, the charging device 4K uniformly charges the surface of the image bearer 2K to high potential. The exposure device 7 irradiates the surface of the image bearer 2K with laser light L according to image data.

The surface of the image bearer 2K irradiated with the laser light L has an electrostatic latent image due to a drop in the potential of the irradiated portion. The developing device 5K includes a developer bearer to bear a developer including toner and transfers unused black toner supplied from the toner bottle 6K onto the irradiated portion of the surface of the image bearer 2K having the electrostatic latent image, through the developer bearer.

The image bearer 2K to which the toner has been transferred forms (develops) a black toner image on the surface of the image bearer 2K. The black toner image formed on the image bearer 2K is transferred onto the intermediate transfer belt 16.

The photoconductor cleaner 3K removes residual toner remaining on the surface of the image bearer 2K after an intermediate transfer operation. The removed residual toner is conveyed by a waste toner conveyor and collected to a waste toner container in the process unit 1K. The discharger discharges the remaining charge on the image bearer 2K from which the remaining toner is removed by the photoconductor cleaner 3K.

Similarly, toner images are formed on the image bearers 2Y, 2M, and 2C in the process units 1Y, 1M, and 1C for the colors, and color toner images are transferred to the intermediate transfer belt 16 such that the color toner images are superimposed on one on another.

The intermediate transfer belt 16 on which the color toner images are transferred and superimposed travels such that the color toner images reach the secondary transfer nip between the secondary transfer roller 20 and the drive roller 18. The registration roller pair 250 rotates to nip the sheet P contacting the registration roller pair 250 at a predetermined timing and conveys the sheet P to the secondary transfer nip of the secondary transfer roller 20 at a suitable timing such that the toner image on the intermediate transfer belt 16 is transferred onto the sheet P. In this manner, the toner image on the intermediate transfer belt 16 is transferred to the sheet P sent out by the registration roller pair 250.

After the toner image is transferred onto the sheet P, the belt cleaner 21 removes residual toner from the intermediate transfer belt 16. In this case, the residual toner is toner that has failed to be transferred onto the sheet, and therefore remains on the intermediate transfer belt 16. The waste toner conveyor conveys the toner removed from the intermediate transfer belt 16 to the powder container 10, and the toner is collected inside the powder container 10.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P, on which the composite toner image has been fixed, is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent out from the fixing device 300 is sent to the sheet ejection path 36 via the post-fixing conveyance path 35. The pair of sheet ejection rollers 37 nip the sheet P sent out to the sheet ejection path 36 and rotate to eject the sheet P to the sheet ejection tray 44. Thus, the single-sided printing is completed.

Next, a description is given of operations of a duplex or double-sided printing. In the case of double-sided printing, firstly, the toner image is transferred onto the sheet P, and the fixing device 300 fixes the unfixed toner image to the sheet P in the same manner as the single-sided printing. After the fixing device 300 fixes the toner image to the sheet P, the sheet P is sent from the fixing device 300 to the sheet ejection path 36. At a timing at which the trailing edge of the sheet P passes through the switching member 42, the switching member 42 pivots on the pivot shaft 42*a* as indicated with a dashed line in FIG. 1A to close the upper end of the post-fixing conveyance path 35. When the upper end of the post-fixing conveyance path 35 is closed, substantially simultaneously, each of the pair of sheet ejection rollers 37 rotates in reverse (in other words, in a direction opposite to the direction to convey a part of the sheet P outside the image forming apparatus 100) to convey the sheet P to an inner side of the image forming apparatus 100, that is, to the reverse conveyance path 41.

The sheet P sent out to the reverse conveyance path 41 reaches the registration roller pair 250 via the reverse conveyance roller pair 43. The registration roller pair 250 temporarily stops the sheet P to correct the leading-edge skew and sends the sheet P to the secondary transfer nip at the optimum timing.

The bias applied at the secondary transfer nip electrostatically transfers the toner image formed by the same operations as above-described image forming operations onto the sheet P. After the toner image is transferred to the sheet P, the sheet P is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300.

The sheet P having the toner images fixed to both front and back sides of the sheet P in this manner is sent out from the fixing device 300 to the post-fixing conveyance path 35. At this time, the switching member 42 is returned to the position at which the upper end of the post-fixing conveyance path 35 is open, as indicated by the solid line of FIG. 1A.

The sheet P sent out from the fixing device 300 is sent to the sheet ejection path 36 via the post-fixing conveyance path 35. The pair of sheet ejection rollers 37 ejects the sheet P to the sheet ejection tray 44. Thus, the duplex printing is completed.

Fixing Device

Next, the fixing devices according to the embodiments of the present disclosure are described below. Various types of fixing devices exist as illustrated in FIG. 2A to FIG. 2D, which will be described later. First, the fixing device 300 is described according to the type illustrated in FIG. 2A.

Figure 2A:
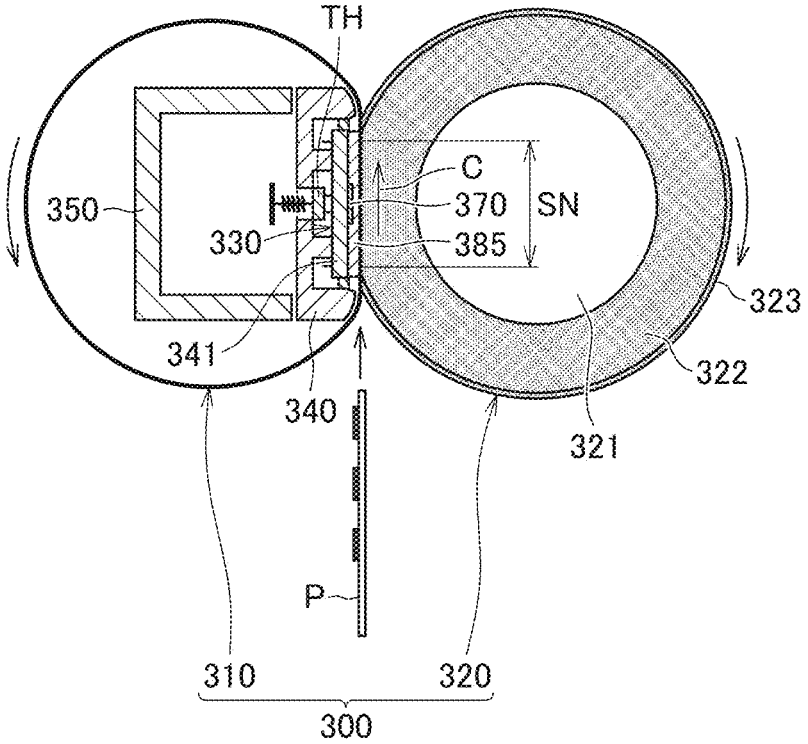
FIG. 2A is a cross-sectional view of a fixing device according to an embodiment of the present disclosure.

As illustrated in FIG. 2A, the fixing device 300 includes a heater 330 as a heat source, a heater holder 340 as a heat source holder, a stay 350 as a support, in addition to the fixing belt 310 and the pressure roller 320.

The fixing belt 310 is a thin endless belt and includes, for example, a tubular base mainly made of polyimide (PI). The tubular base has an outer diameter of 25 mm and a thickness of 40 to 120 μm. The base of the fixing belt 310 may be made of heat-resistant resin such as polyetheretherketone (PEEK) or metal such as nickel (Ni) or stainless steel (steel use stainless, SUS), in addition to polyimide. In the case that the base is made of metal, a sliding layer made of polyimide, polytetrafluoroethylene (PTFE), or the like may be on the inner circumferential surface of the base.

The fixing belt 310 further includes a release layer serving as an outermost surface layer. The release layer is made of fluororesin, such as tetrafluoroethylene-perfluoroalkylvinylether copolymer (PFA) or polytetrafluoroethylene (PTFE) and has a thickness of from 5 μm to 50 μm to enhance durability of the fixing belt 310 and facilitate separation of the sheet P from the fixing belt 310. Optionally, an elastic layer that is made of rubber or the like and has a thickness in a range of from 50 μm to 500 μm may be interposed between the base and the release layer.

The pressure roller 320 having, for example, an outer diameter of 25 mm, includes a core 321 that is a solid iron core, an elastic layer 322 on the outer circumferential surface of the core 321, and a release layer 323 formed on the outer circumferential surface of the elastic layer 322. The elastic layer 322 is, for example, made of silicone rubber and has a thickness of 3.5 mm. The release layer 323 is, for example, made of fluororesin and has a thickness of approximately 40 μm.

A biasing member such as a spring presses the pressure roller 320 against the fixing belt 310 to press the pressure roller 320 against the outer circumferential surface of the fixing belt 310. Thus, a fixing nip SN as a nip is formed between the fixing belt 310 and the pressure roller 320. In other words, the fixing nip SN is formed on a contact portion between the fixing belt 310 and the pressure roller 320.

A stay 350 and a heater holder 340 are disposed inside the loop of the fixing belt 310.

The heater holder 340 holds the heater 330. Since the heater holder 340 is subject to temperature increase by heat from the heater 330, the heater holder 340 is preferably made of a heat-resistant material. In the case that the heater holder 340 is made of heat-resistant resin having low heat conductivity, such as a liquid crystal polymer (LCP) or polyether ether ketone (PEEK), the heater holder 340 can have a heat-resistant property and reduce heat transfer from the heater 330 to the heater holder 340. As a result, the heater 330 can efficiently heats the fixing belt 310.

The stay 350 supports the heater holder 340. The stay 350 supports a stay side face of the heater holder 340. The stay side face is opposite a nip side face of the heater holder 340 facing the fixing nip SN. Accordingly, the stay 350 prevents the heater holder 340 from being bended by a pressing force of the pressure roller 320. Thus, the fixing nip SN having a uniform width is formed between the fixing belt 310 and the pressure roller 320. The stay 350 is preferably made of an iron-based metal such as steel use stainless (SUS) or steel electrolytic cold commercial (SECC) that is electrogalvanized sheet steel to ensure rigidity.

The heater 330 extends in a longitudinal direction of the fixing belt 310 (that is a sheet width direction intersecting a sheet conveyance direction). In addition, the heater 330 is in contact with the inner circumferential surface of the fixing belt 310 to heat the inner circumferential surface of the fixing belt 310. Optionally, the fixing device may include a heater to heat the pressure roller 320. The heater 330 according to the present embodiment includes a planar substrate 341, a resistive heat generator 370 disposed on a fixing nip side of the substrate 341, and an insulation layer 385 covering the resistive heat generators 370. The fixing nip side of the substrate 341 faces the fixing nip SN. The substrate 341 is made of a material having excellent heat resistance and insulating properties, such as polyimide, glass, mica, or ceramic such as alumina or aluminum nitride. Alternatively, the substrate 341 may be an insulation layer formed on a metal plate made of metal (that is a conductive material) such as steel use stainless (SUS), iron, or aluminum. In particular, the substrate 341 made of a high thermal conductive material such as aluminum, copper, silver, graphite, or graphene improves the thermal uniformity of the heater 330 and image quality. The resistive heat generator 370 is, for example, produced as below. Silver-palladium (AgPd), glass powder, and the like are mixed to make paste. The paste is screen-printed on the surface of the substrate 341. Thereafter, the substrate 341 is subject to firing. Then, the resistive heat generator 370 is produced. The material of the resistive heat generator 370 may contain a resistance material, such as silver alloy (e.g., AgPt) or ruthenium oxide (e.g., $RuO_2$). The insulation layer 385 is made of a material having excellent heat resistance and insulating properties, such as polyimide nitride, glass, mica, or ceramic such as alumina or aluminum.

A thermistor TH as a temperature detector is disposed on the heater 330. The output of the heater 330 is controlled based on temperatures detected by the thermistor TH to maintain the temperature of the fixing belt 310 to be a predetermined temperature. The thermistor TH in the present embodiment is disposed so as to be in contact with the substrate 341 of the heater 330, but the temperature detector that detects the temperature of the heater 330 is not limited to a contact type temperature sensor. The temperature detector may be a non-contact type temperature sensor.

In the fixing device according to the above-described present embodiment of the present disclosure, the heater is in contact with the inner circumferential surface of the fixing belt, and rotations of the pressure roller rotate the fixing belt. As a result, the fixing belt slides on the heater. The fixing belt sliding on the heater may generate abnormal noise, and the fixing belt may wear.

One of countermeasures to prevent the above-described problems is applying lubricant such as grease to a sliding portion between the fixing belt and the heater. Interposing the lubricant between the fixing belt and the heater improves sliding performance of the fixing belt with respect to the heater and prevents occurrence of the abnormal noise and the wear of the fixing belt.

Relationship Between Surface Roughness and Lubricant Holding Performance

In the present embodiment, a surface roughness of a sliding surface of the fixing belt and a surface roughness of a slide surface of the heater, which slide each other, are adjusted to prevent the occurrence of the abnormal noise and the wear of the fixing belt in addition to applying the lubricant.

Figure 3A:
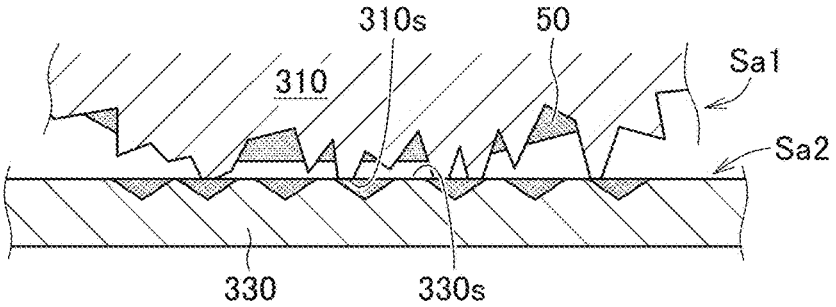
FIG. 3A is a schematic diagram illustrating lubricant held between a heater and a fixing belt with a surface roughness larger than a surface roughness of the heater.

The following describes a relationship between the surface roughness and lubricant holding performance. As illustrated in FIG. 3A, increasing surface roughness of the sliding surface 310*s* (that is the inner circumferential surface) of the fixing belt 310 to be larger than the surface roughness of the slide surface 330*s* of the heater 330 increases the size of each of spaces of minute recesses in the sliding surface 310*s*. Lubricant 50 on the heater 330 cannot fill the spaces of minute recesses. This means that the lubricant 50 does not exist portions between minute projections of the sliding surface 310*s* of the fixing belt 310 and the slide surface 330*s* of the heater 330. No lubricant between the minute projections of the sliding surface 310*s* of the fixing belt 310 and the slide surface 330*s* of the heater 330 is likely to cause the abnormal noise and the wear of the fixing belt. In addition, the inner circumferential surface of the fixing belt sliding on the heater deteriorates and forms scratches that cause unevenly heating the toner image. As a result, an abnormal image such as an uneven gloss or a gloss streak of the toner image occurs.

Figure 3B:
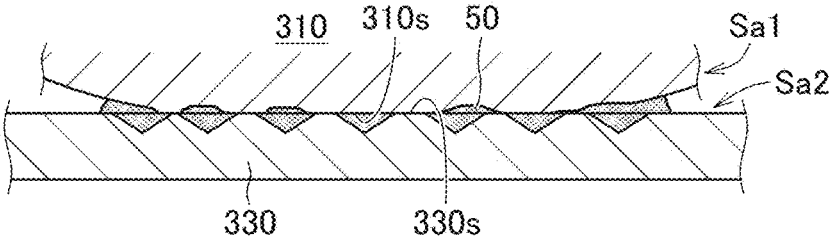
FIG. 3B is a schematic diagram illustrating lubricant held between the fixing belt and the heater with the surface roughness larger than the surface roughness of the fixing belt.

In contrast, as illustrated in FIG. 3B, increasing the surface roughness of the slide surface 330*s* of the heater 330 to be larger than the surface roughness of the sliding surface 310*s* of the fixing belt 310 enables the lubricant 50 on the heater 330 to fill the spaces of the minute recesses in the inner circumferential surface of the fixing belt 310. As a result, the lubricant 50 is interposed between the minute projections of the sliding surface 310*s* of the fixing belt 310 and the slide surface 330*s* of the heater 330, which can prevent the abnormal noise and the wear of the fixing belt.

Based on the above, in the fixing device according to the present embodiment, the surface roughness of the slide surface of the heater is set to be larger than the surface roughness of the sliding surface of the fixing belt to prevent the abnormal noise and the wear of the fixing belt.

Next, parameters representing the surface roughness is described.

Line Roughness Ra

One of the parameters representing the surface roughness is an arithmetic average roughness Ra, which is also called as a line roughness, based on JIS B 0031 of the Japanese Industrial Standards (JIS). Specifically, the line roughness Ra is obtained as follows. The roughness curve of the slide surface of the heater is measured. The line roughness Ra is an average of absolute values of height differences each of which is a height difference from an average surface of the surface to each point. The line roughness Ra is obtained by the following expression (1), where y is the height at a position x.

Expression 1

$$Ra = \frac{1}{A}\int_0^A \{f(x)\}dx \tag{1}$$

As described above, the larger surface roughness of the slide surface of the heater is preferable to prevent the abnormal noise and the wear of the fixing belt. For this reason, the line roughness Ra of the slide surface of the heater in the present embodiment is set to be 0.2 μm or more in a sliding direction (that is a moving direction C of the fixing belt 310 at the fixing nip SN in FIG. 2A). In contrast, since the smaller surface roughness of the sliding surface of the fixing belt is preferable, the line roughness Ra of the sliding surface of the fixing belt in the sliding direction is 0.05 μm or less in the present embodiment. Setting the line roughness Ra of each of the slide surface of the heater and the sliding surface of the fixing belt as described above can stably maintain the lubricant holding performance on the slide surface of the heater and effectively prevent the abnormal noise and the wear of the fixing belt.

Surface Roughness Sa

Figure 4A:
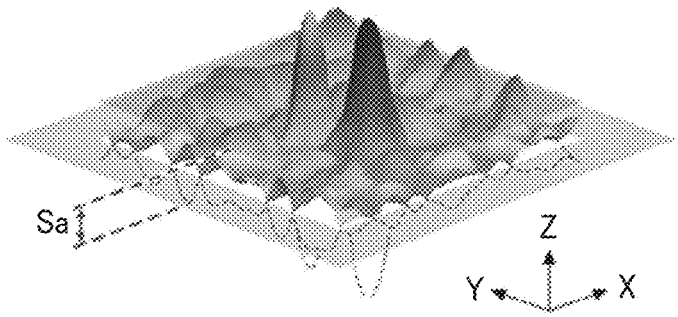
FIG. 4A is a diagram illustrating an arithmetic average roughness.

Another one of the parameters representing the surface roughness is an arithmetic average roughness Sa that is obtained by a measurement method based on ISO 25178. The surface roughness Sa is a value obtained by three dimensionally expanding the line roughness Ra. That is, the surface roughness Ra is an average of absolute values of Z (x, y) (that is, height differences from an average plane) in a measurement target region illustrated in FIG. 4A, which is obtained by the following expression 2.

Expression 2

$$Sa = \frac{1}{A}\int\int_A |Z(x, y)|dxdy \tag{2}$$

Similar to the above, the surface roughness Sa of the slide surface of the heater is preferably 0.2 μm or more. In addition, the surface roughness Sa of the sliding surface of the fixing belt is preferably 0.05 μm or less.

Valley Void Volume Vvv

Figure 4B:
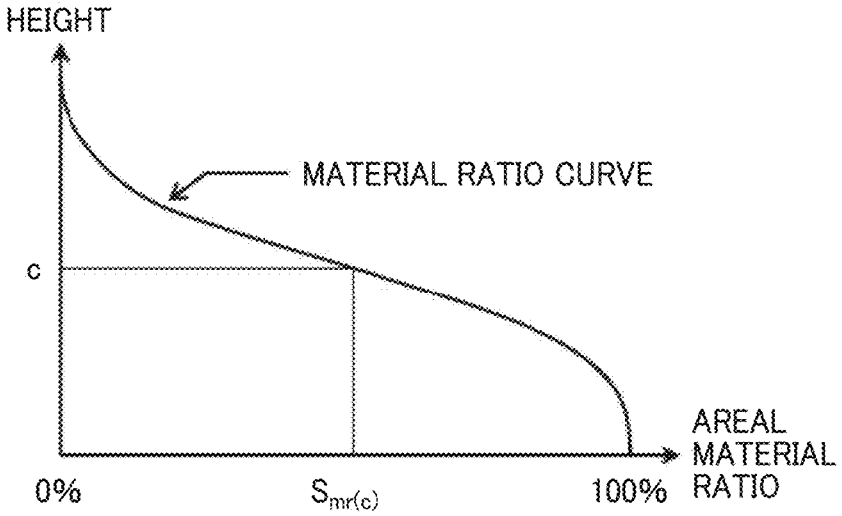
FIG. 4B is a graph illustrating a material ratio curve.
Figure 4C:
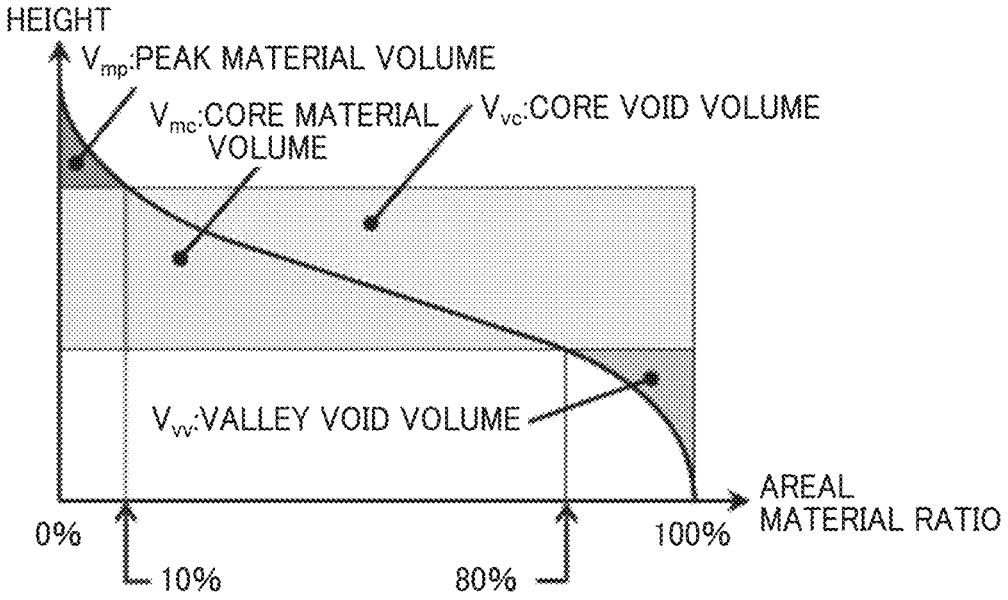
FIG. 4C is a graph illustrating a material ratio curve representing a material volume and a void volume.

In addition to the line roughness Ra and the surface roughness Sa, one of the parameters representing the surface roughness (that is, surface shape parameters) is a valley void volume Vvv defined by ISO 25178. To improve the wear resistance of the fixing belt in the fixing device according to the present embodiment, the valley void volume Vvv of the slide surface of the heater is preferably 0.01 ml/m$^2$ or more. The valley void volume Vvv is calculated as a volume of a region in which an areal material ratio Smr(c) is from p % to 100% in a material ratio curve illustrated in FIG. 4B. The material ratio curve represents heights c when the areal material ratio Smr(c) is from 0% to 100%. The present inventors use p=80% to calculate the valley void volume Vvv. In other words, the valley void volume Vvv is the volume of the region in which the areal material ratio Smr(c) is from 80% to 100% in the material ratio curve (see FIG. 4C). As the valley void volume Vvv increases, the volume of the valley increases, which means that the slide surface of the heater holds more lubricant. Setting the valley void volume Vvv of the slide surface of the heater to 0.01 ml/m$^2$ or more increases an amount of lubricant held by the slide surface of the heater and efficiently prevents the wear of the fixing belt.

Skewness Ssk

Another parameter representing the surface roughness is a skewness Ssk. The skewness Ssk represents the symmetry of a height distribution and is calculated by the following expression 3.

Expression 3

$$Ssk = \frac{1}{S_q^3}\left[\frac{1}{A}\int\int_A Z^3(x, y)dxdy\right] \tag{3}$$

Figure 4D:
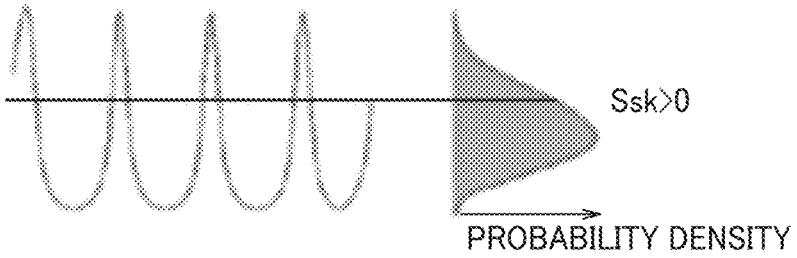
FIG. 4D is a graph illustrating a height distribution of a surface with a skewness Ssk larger than zero and a schematic sectional view of the surface.
Figure 4E:
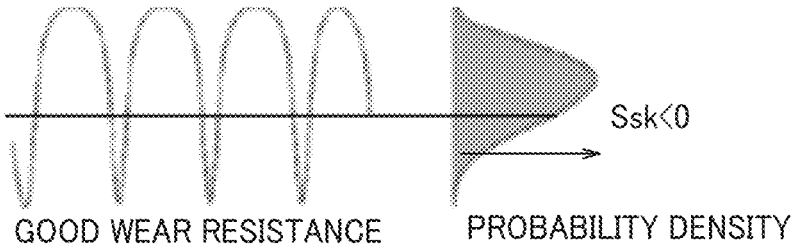
FIG. 4E is a graph illustrating a height distribution of a surface with the skewness Ssk smaller than zero and a schematic sectional view of the surface.

In the case of the Skewness larger than zero, the surface has many pointed top portions (in other words, many pointed mountains) as illustrated in FIG. 4D. In the case of the skewness smaller than zero, the surface has many round top portions (in other words, many round mountains) as illustrated in FIG. 4E. The height distribution with Ssk=0 is vertically symmetrical.

To improve the wear resistance of the slide surface of the heater, the slide surface having many round top portions is more preferable than the slide surface having many pointed top portions. For this reason, the skewness Ssk of the slide surface of the heater in the present embodiment is set to be smaller than zero.

Kurtosis Sku

Another parameter representing the surface roughness (that is, the surface shape parameter) is kurtosis Sku. The kurtosis Sku represents the sharpness of the height distribution and is calculated by the following expression 4.

Expression 4

$$Sku = \frac{1}{S_q^4}\left[\frac{1}{A}\int\int_A Z^4(x, y)dxdy\right] \tag{4}$$

Figure 4F:
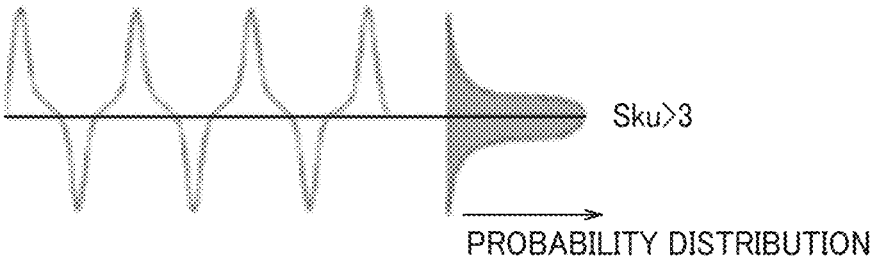
FIG. 4F is a graph illustrating a height distribution of a surface with a kurtosis Sku larger than three and a schematic sectional view of the surface.
Figure 4G:
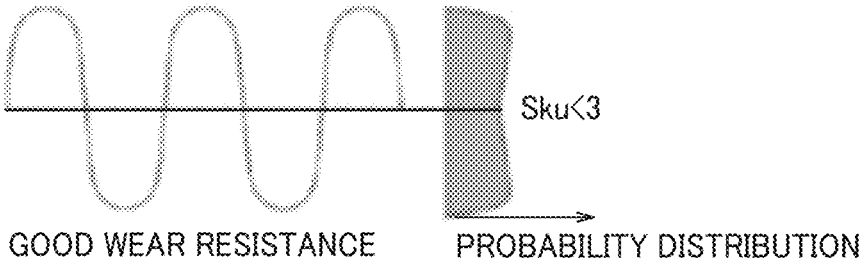
FIG. 4G is a graph illustrating a height distribution of a surface with the kurtosis Sku smaller than three and a schematic sectional view of the surface.

In the case of kurtosis Sku larger than three, the surface has sharp top portions (in other words, sharp mountains) and sharp recesses (in other words, sharp valleys) as illustrated in FIG. 4F. In the case of kurtosis Sku smaller than three, the surface has round top portions (in other words, round mountains) and round recesses (in other words, round valleys) as illustrated in FIG. 4G. In the case of kurtosis equal to three, the height distribution is a normal distribution.

To improve the wear resistance of the slide surface of the heater, the slide surface having round top portions is more preferable than the slide surface having sharp top portions.

For this reason, the kurtosis Sku of the slide surface of the heater in the present embodiment is set to be smaller than three.

Measurement Methods of Surface Shape Parameters

Each of the above-described various surface shape parameters (the line roughness Ra, the surface roughness Sa, the valley void volume Vvv, the skewness Ssk, and the kurtosis Sku) is measured by a VK-X100® manufactured by Keyence Corporation using an objective lens having a magnification of 50 times. The sample of the fixing belt was measured after the fixing belt was set on a flat surface and confirmed that there was no large inclination or waviness at an observation position.

Elastic Power

As described above, setting the surface roughness of the slide surface of the heater larger than the surface roughness of the sliding surface of the fixing belt and appropriately setting various surface shape parameters of the slide surface of the heater can effectively prevent the abnormal noise and the wear of the fixing belt caused by sliding of the fixing belt.

However, the fixing belt is worn over time due to sliding of the fixing belt, which produces abrasion powder. The abrasion powder absorbs the lubricant. As a result, the abrasion powder reduces the lubricity of the sliding portion between the fixing belt and the heater and is likely to cause the abnormal noise. For this reason, the wear resistance of the fixing belt in the present embodiment is improved to prevent the occurrence of the abnormal noise.

The present inventors conducted tests each evaluating the wear of fixing belt to improve the wear resistance of the fixing belt. As a result, the present inventors found that increasing an elastic power of an inner portion having the sliding surface of the fixing belt improves the wear resistance of the fixing belt. The following describes the relationship between the elastic power and the wear resistance.

The elastic power is obtained by taking a relationship between load and displacement of a member to which the load is applied, calculating the amount of work of elastic deformation, and dividing the amount of work of elastic deformation by the total amount of work (that is the sum of the amount of work of elastic deformation and an amount of work of plastic deformation). The elastic power is expressed by the following expression 5. The closer the elastic power is to 1 (100%), the more easily the member is elastically deformed.

Expression 5

$$\text{Elastic Power (\%)} = \text{Amount of work of elastic deformation}/\text{Total Amount of work} \times 100 \quad (5)$$

Method for Measuring Elastic Power

Figure 5A:
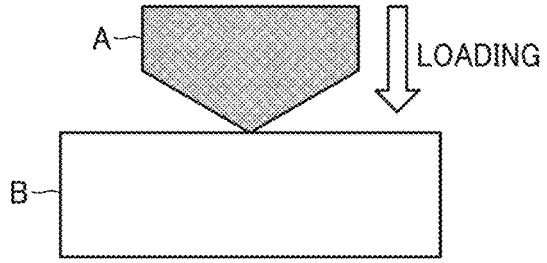
FIGS. 5A to 5D are explanatory diagrams illustrating a method for measuring elastic power.
Figure 5B:
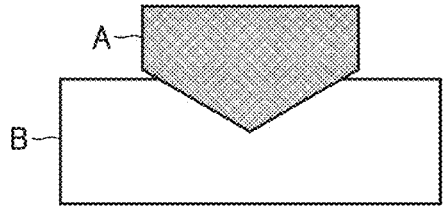
Figure 5C:
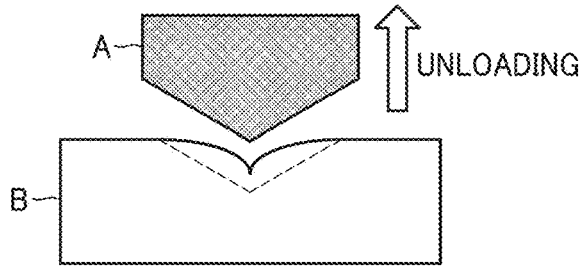

The elastic power may be measured by a loading-unloading test (i.e., an indentation test) of a micro surface hardness tester using a diamond indenter. Specifically, as illustrated in FIG. 5A, a diamond indenter A is in contact with a sample B. Next, as illustrated in FIG. 5B, the diamond indenter A is shoved into the sample B at a constant load speed (that is, a loading process) and stops for a constant time after a shoving load reaches a set load. Subsequently, the diamond indenter A is pulled up at a constant unloading speed (that is, an unloading process). Finally, the load is not applied to the sample B as illustrated in FIG. 5C.

Figure 5D:
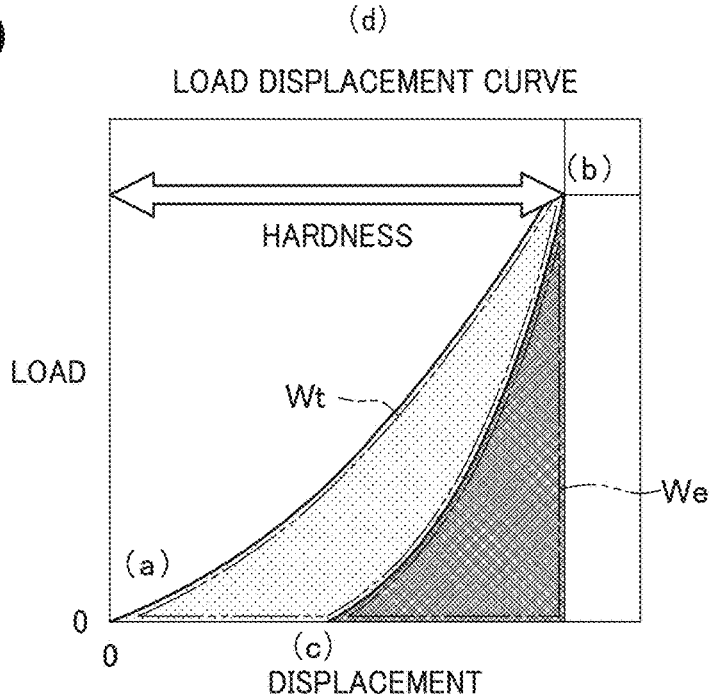

FIG. 5D is a graph illustrating the above-described relationship between the load (that is, an indentation load) and the displacement (that is, a shoved amount). The origin (a) of FIG. 5D illustrates a state in which the diamond indenter A has started to come into contact with the sample B, as illustrated in FIG. 5A, and both the load of the diamond indenter A and the displacement of the sample B are 0. Subsequently, a point (b) of FIG. 5D illustrates a state in which the indentation load has reached the set load, as illustrated in FIG. 5B, and both the load of the diamond indenter A and the displacement of the sample B become maximum. Finally, a point (c) of FIG. 5D illustrates a state in which the diamond indenter A is pulled up and no load is applied to the sample B, as illustrated in FIG. 5C. At the point (c), the diamond indenter A does not apply load to the sample B, that is, the load=0, but the displacement of the sample B does not become 0 because plastic deformation occurs in the sample B. In FIG. 5D, a black part We represents the amount of work of elastic deformation, and a gray part Wt represents the amount of work of plastic deformation.

The elastic power is obtained by recording the relationship between the load and the displacement (as illustrated in the graph of FIG. 5D) in the above-described loading-unloading test and calculating, from the relationship, the ratio of the work amount We of elastic deformation to the total work amount (that is the work amount We of elastic deformation + the work amount Wt of plastic deformation) performed on the surface layer by the diamond indenter A.

The present inventors measured the elastic powers of the inner portions of the fixing belts in the present embodiment under constant temperature and humidity. Specifically, the present inventors measured the elastic powers under an environmental condition of a temperature of 23° C. and a relative humidity of 50%. The measurement was performed as follows. A Fischer scope HM-2000® (manufactured by Fischer Instruments K. K.) and a Vickers's indenter were used. The load was applied under the conditions of a set load 20 mN, a time 30 sec until reaching the maximum load, and a creep time 5 sec. Unloading was performed during 30 sec. However, the measurement may be performed by any device having an equivalent performance.

In the measurements, samples that were fixing belts were closely attached to a metal board to measure the elastic power. Since the elastic power is affected by the spring characteristics of the board, a rigid metal plate, slide glass, or the like is suitable as the board. The set load was adjusted so that the maximum displacement was 1/10 of the thickness of the inner portion to decrease influences due to factors of hardness and elasticity of layer adjacent to the inner portion (for example, the base made of metal in the fixing belt). Preferably, the elastic layer made of rubber and the release layer are removed when the measurement is performed to exclude the influence of the elastic layer made of rubber and the release layer on the base. The present inventors removed the elastic layer and the release layer from the fixing belt when the measurement was performed.

Difference of Wear Due to Elastic Power

Figure 6:
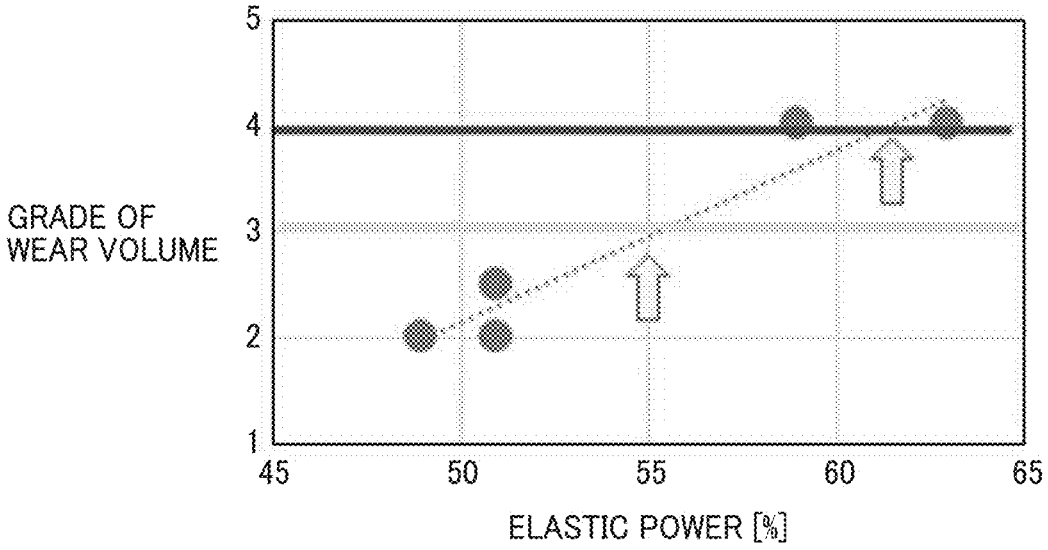
FIG. 6 is a graph illustrating a relation between grades of wear volumes of fixing belts and the elastic powers of the bases of the fixing belts.

FIG. 6 is a graph illustrating a relation between grades of wear volumes of fixing belts and the elastic powers of the bases of the fixing belts that is obtained by the above-described measurement.

A test to evaluate the wear resistance of the fixing belt was performed as follows. The fixing belt was assembled to the fixing device. The heater heated the fixing belt and was controlled so that the temperature of the fixing belt was a constant temperature (that is a fixing temperature), and the fixing device repeated rotating the fixing belt and stopping the rotation of the fixing belt until the rotation distance of the fixing belt reached the lifetime distance. The fixing device used in this evaluation test was configured by the fixing belt including a polyimide layer as the inner portion having the inner circumferential surface of the fixing belt, the heater as the nip formation pad including a glass layer, the heater holder, and the pressure roller. After the fixing device repeats rotating the fixing belt and stopping the rotation of the fixing belt until the rotation distance of the fixing belt reaches the lifetime distance, the wear state of the fixing belt was checked.

After each of the evaluation tests, the inner portion of the fixing belt was worn, and large wear volumes caused gloss unevenness such as gross streaks in a solid image. Results of the evaluation tests were expressed by grades of wear volumes 1 to 5 as illustrated in the vertical axis of FIG. 6. Grade 1 means that a large number of gross streaks clearly occurred in the solid image after the evaluation test. Grade 2 means that gross streaks clearly occurred in the solid image after the evaluation test. Grade 3 means that gross streaks slightly occurred in the solid image after the evaluation test. Grade 4 means that the gloss streak was not recognized in the solid image after the evaluation test, in other words, the wear of the fixing belt does not affect the image quality. Grade 5 means that a streak was not found in the inner circumferential surface of the fixing belt after the evaluation test. When the grade of wear volume was grade 3, the fixing belt worn after the evaluation test was evaluated as a practically usable level.

From the test results illustrated in FIG. 6, setting the elastic power to 55% or more can ensure practical wear resistance performance, and, in addition, setting the elastic power to be 62% or more can ensure high quality wear resistance. The present inventors considers as follows. The elastic power indicates how much the object returns when no force is applied to the object after the force is applied to the object. The object having the large elastic power easily returns to the original form when no force is applied to the object after the force is applied. Accordingly, setting the large elastic power reduces a permanent distortion of the inner portion having the sliding surface of the fixing belt caused by the force due to sliding the fixing belt on the heater. This reduces the damage of the fixing belt.

As a result, the present inventors found that setting the elastic power of the inner portion having the sliding surface of the fixing belt to 55% or more improves the wear resistance of the inner portion having the sliding surface of the fixing belt and can effectively prevent the occurrence of the abnormal noise at the sliding portion over a long period of time. In addition, the present inventors found that setting the elastic power of the inner portion having the sliding surface of the fixing belt to 62% or more can effectively prevent the occurrence of the abnormal noise at the sliding portion over a long period of time and prevent the occurrence of the abnormal images such as the streak. As a result, high-quality images were provided.

Additionally, setting each of the surface shape parameters (that is, the line roughness Ra, the surface roughness Sa, the valley void volume Vvv, the skewness Ssk, and the kurtosis Sku) of the slide surface of the heater as described above can effectively prevent the abnormal noise and the wear of the fixing belt caused by the sliding of the fixing belt.

The lubricant interposed in the sliding portion between the heater and the fixing belt may include fluorine grease or silicone oil. Interposing such a lubricant in the sliding portion enables maintaining lubricity over a long period of time even in the sliding portion under high temperature and high pressure and reducing the wear of the fixing belt. The lubricant is preferably applied to the heater. Applying the lubricant to the slide surface of the heater having a relatively large surface roughness and rotating the fixing belt can spread the surplus of the lubricant on slide surface of the heater over the entire sliding surface of the fixing belt having a relatively small surface roughness. In contrast, relatively increasing the surface roughness of the sliding surface of the fixing belt increases the amount of lubricant required to spread over the entire sliding surface of the fixing belt, and thus the amount of lubricant applied to the slide surface of the heater may be insufficient. In order to solve the above-described shortage of the lubricant, a method of applying the lubricant to the entire sliding surface of the fixing belt may be considered. However, this method increases the amount of the lubricant required to be larger than the amount of lubricant applied to the heater. In addition, a large amount of lubricant to be applied causes the lubricant to leak from both ends (opening portions) of the fixing belt, which may cause an abnormal image such as uneven gloss. Uniformly applying the lubricant so that the lubricant does not leak from the fixing belt is difficult in production processes, which is impractical. Accordingly, the lubricant is preferably applied to the heater.

The fixing belt including the base, the release layer as the surface layer on the outer circumferential surface of the base and not including the elastic layer such as a rubber layer between the base and the release layer has a smaller rigidity than the fixing belt including the elastic layer. The fixing belt having the smaller rigidity tends to follow the shape of the nip entrance. As a result, the fixing belt closely adhere to the heater, which causes capillary phenomenon. Due to the capillary phenomenon, the lubricant is easily supplied to the sliding portion between the heater and the fixing belt, and the lubricity in the sliding portion is effectively obtained.

Difference Between Elastic Power and Return Rate

There is a return rate as an index similar to the elastic power. The "return rate" is a value expressed by the following expression 6, where h1 is the maximum displacement of a target member to which a load is applied, and h2 is a displacement after the load is removed (see FIG. 7).

Expression 6

$$\text{Return rate (\%)} = \frac{h_1 - h_2}{h_1} \times 100 \tag{6}$$

Figure 7:
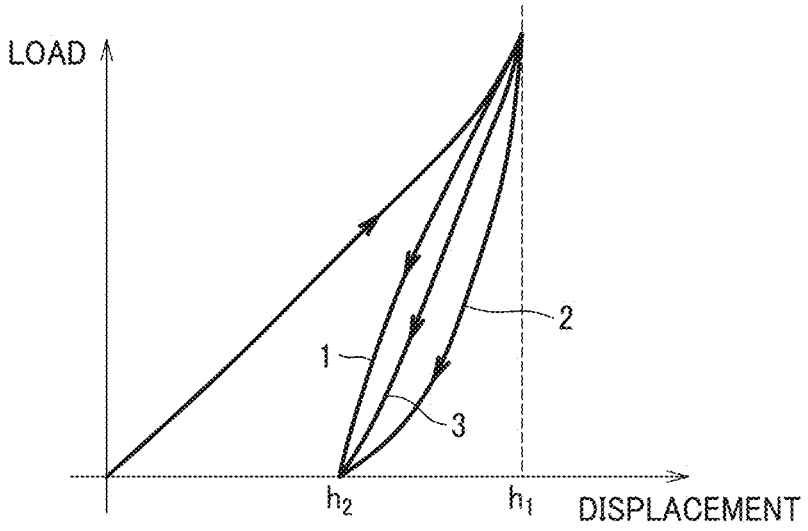
FIG. 7 is a load-displacement diagram illustrating the difference between the elastic power and return rate.

FIG. 7 is a graph representing the relationship between the load applied to the target member and the displacement of the target member and illustrating different return lines 1, 2, 3. The return line changes depending on a return speed. The return speed is a speed when the displacement of the target member changes from h1 to h2 (in other words, the speed at which the shape of the target member returns after deformation). Since the return rate represents the ratio of the displacement difference to the maximum displacement amount without considering the difference in the return speed, the above target members having different return lines have the same return rate value.

In contrast, the elastic power is a value indicating an energy loss when the target member elastically returns the shape of the target member during the unloading process, which means that the elastic power includes information of the return speed. As a result, the elastic powers are different in the target members having the different return lines 1, 2, 3. The target members having the same return rate may have different elastic powers depending on profiles during the unloading process. The frictional force (that affects a rotational torque) at the sliding portion of the fixing belt may be different depending on the difference in the elastic power. Specifically, increasing the difference in energy loss obtained from the elastic power increases the frictional force (that affects a rotational torque) at the sliding portion of the fixing belt. For this reason, the elastic power that relates to the frictional force in addition to the wear resistance is more useful than the return rate that cannot determine the presence or absence of the frictional force and the magnitude relationship of the frictional force as a characteristic of the sliding surface of the fixing belt or the like.

Manufacturing Method of Fixing Belt

A main ingredient of the tubular base of the fixing belt according to the embodiment of the present disclosure is polyimide (PI). The polyimide as the main ingredient can increase elastic power of the base. In the case that the base is made of metal, paint containing polyimide may be applied to the inner circumferential surface of the base.

The following describes a method of manufacturing the fixing belt according to the present embodiments.

Firstly, preparation of coating liquid for the fixing belt is described. To make the coating liquid, a preparation liquid A was prepared by adding N-methyl-pyrrolidone (NMP) 80 g to the polyimide varnish 100 g and mixing. As the polyimide varnish, U-imide varnish AR® manufactured by UNITIKA LTD. was used. NMP was N-methyl-pyrrolidinone special grade manufactured by Kanto Chemical Co., Inc. As a result, a preparation liquid A was prepared. Needle-shaped inorganic filler was gradually added to the above-described preparation liquid A while performing blade stirring by a desktop mixer, and kneading was performed. The needle-shaped inorganic filler 20 g was added to the polyimide varnish 100 g. The needle-like inorganic filler was gradually added and kneaded over about 10 to 15 minutes so as not to form beads. As the needle-like inorganic filler, TISMO D® manufactured by Otsuka Chemical Co., Ltd. was used. As a result, the coating liquid B was prepared.

The coating liquid B was coated to the inner circumferential surface of the fixing belt as follows. Coating method to coat the coating liquid B to the inner circumferential surface of the fixing belt is generally spray coating or dipping coating. Present inventors used the spray coating. The coating liquid B was put into a pumping tank. The fixing belt as an object to be coated was rotated in order to coat the coating liquid B to the inner circumferential surface of the fixing belt. The number of rotations of the fixing belt is set in a range of 900 to 1000 rpm. The number of rotations of the fixing belt was set to 900 rpm. The present inventors set a coating speed to be 30 mm/s. A coating weight in one coating process of a plurality of coating processes was set to be in a range of 0.7 to 1.2 g. The coating weight is adjusted by the pressure at which the coating liquid B is pumped. The present inventors set the pressure to be 125 kPa, and the coating weight in one coating process was 1.0 g. After coating, preliminary drying was carried out with hot air at 200° C., and the coating process was repeated. The coating process and preliminary drying were repeated three to four times. After completion of each coating process, in order to volatilize NMP, the fixing belt was put into a drying furnace at 260° C. and heat-treated for 30 minutes. The film thickness of the sliding layer was 8 to 15 μm. For example, when the coating liquid B 4.2 g was applied, the film thickness was 11 μm.

Subsequently, the fixing belt was fired. Firing process was carried out in a vertical type far-infrared firing furnace. The vertical type far-infrared firing furnace included far-infrared heaters laterally disposed. Each of the far infrared heaters had a heating range equal to or longer than the fixing belt. The fixing belt was vertically disposed between the far-infrared heaters. The temperature of the far-infrared heaters was set so that the fixing belt had a predetermined temperature. The temperature of the far-infrared heaters was set so that the actual temperature of the fixing belt was 360° C. Firing time was 30 minutes.

The present inventors measured the elastic power of the inner portion having the sliding surface of the fixing belt manufactured as described above. The elastic power was 70.0% under 23° C. that is an example of a room temperature and 60.2% under 165° C. that is an example of a temperature of fixing belt heated in the fixing device. Thus, the elastic power was 55% or more under the above-described both temperature conditions. As described above, 55% or more of the elastic power is a target for improving the wear resistance of the fixing belt.

Changing firing conditions enables adjusting the elastic power of the fixing belt. The following describes other firing conditions.

The temperature of the far-infrared heaters was set so that the actual temperature of the fixing belt was 280° C. Firing time was 30 minutes. Conditions other than the firing temperature and the firing time are the same as those in the above-described production method.

The present inventors measured the elastic power of the inner portion having the sliding surface of the fixing belt manufactured under the above-described different firing conditions. The elastic power was 60.4% under 23° C. that is the example of the room temperature and 52.1% under 165° C. that is the example of the temperature of fixing belt heated in the fixing device.

As described above, changing the firing conditions of the fixing belt made of polyimide as the material of the base of the fixing belt enables appropriately adjusting the elastic power of the inner portion having the sliding surface of the fixing belt. In other words, using polyimide as the material of the base of the fixing belt enables easily adjusting the elastic power of the fixing belt to a desired value to improve the wear resistance of the fixing belt. The material of the fixing belt according to the present disclosure is not limited to polyimide. Heat-resistant resin such as PEEK may be used. Alternatively, the base of the fixing belt may be made of a metal material such as nickel or SUS, and polyimide, PTFE, or the like may be applied to the base of the fixing belt. The surface roughness of the inner circumferential surface of the fixing belt may be adjusted as follows. Changing the size or shape of the filler contained in the coating liquid can control the surface roughness of the inner circumferential surface of the fixing belt. Polishing the inner circumferential surface of the fixing belt can also control the surface roughness of the inner circumferential surface of the fixing belt. Polishing the slide surface of the secured member can control the surface roughness of the slide surface of the secured member.

Other Fixing Devices

Figure 2B:
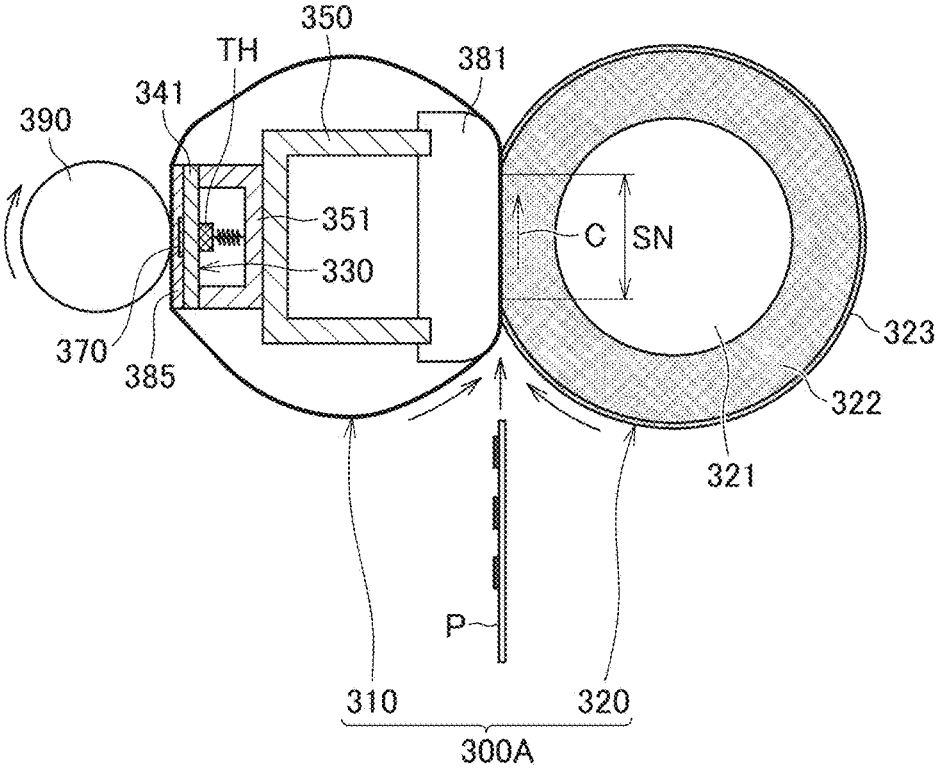
FIG. 2B is a cross-sectional view of a fixing device according to an embodiment of the present disclosure.
Figure 2C:
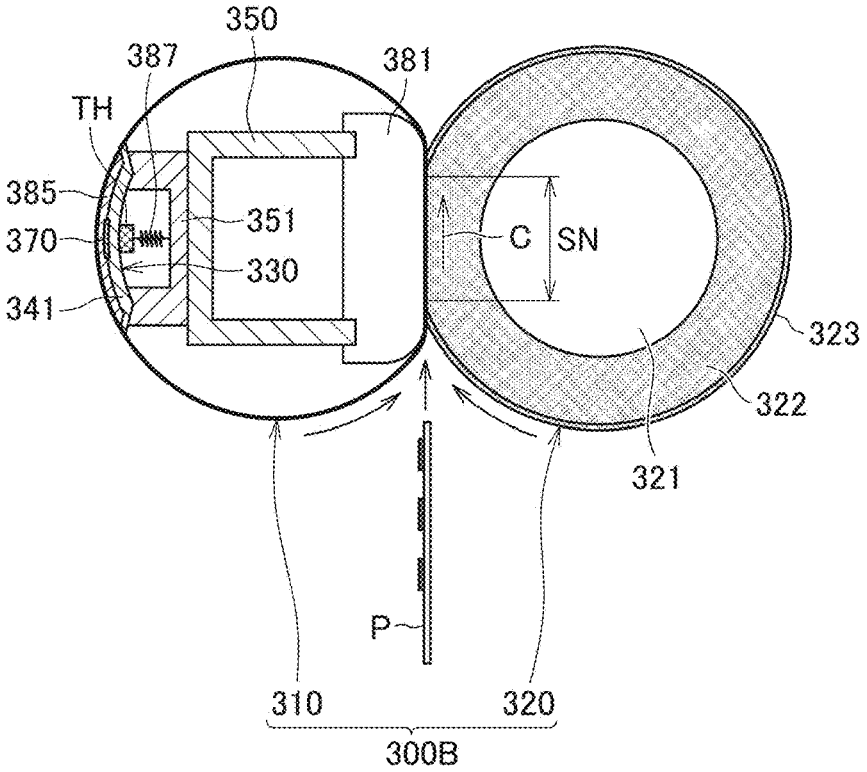
FIG. 2C is a cross-sectional view of a fixing device according to an embodiment of the present disclosure.
Figure 2D:
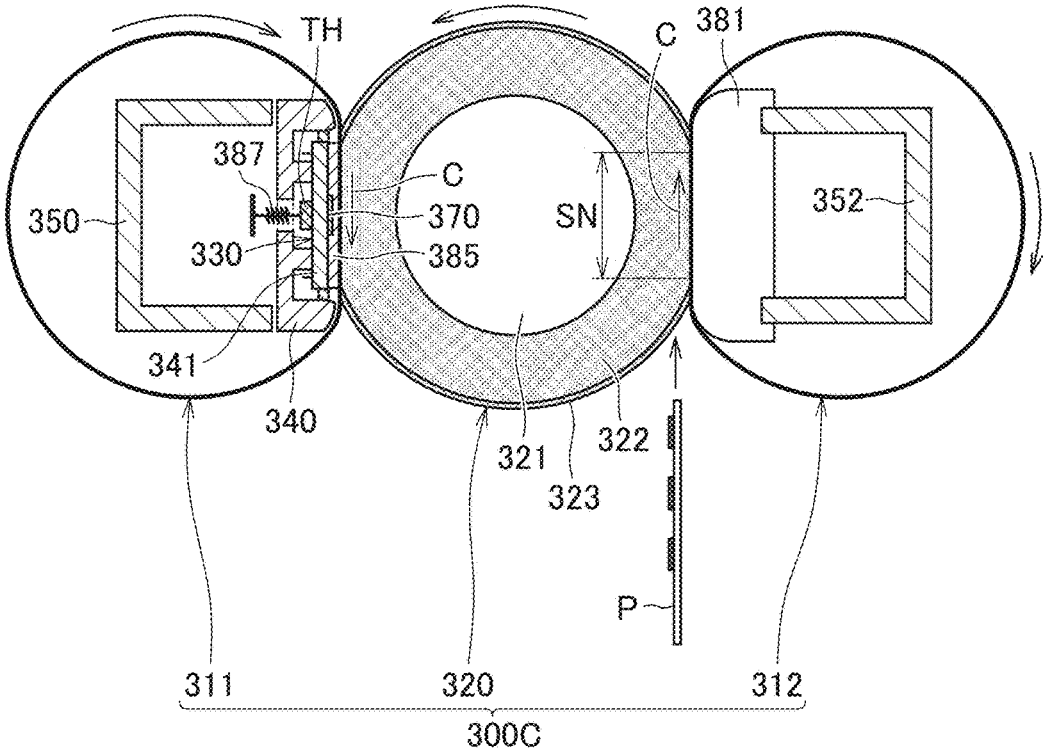
FIG. 2D is a cross-sectional view of a fixing device according to an embodiment of the present disclosure.

The fixing device according to the present disclosure is not limited to the fixing device 300 in the embodiment illustrated in FIG. 2A. The fixing device according to the present disclosure may be fixing devices 300A to 300C illustrated in FIGS. 2B to 2D respectively. With reference to FIGS. 2B to 2D, the fixing devices 300A, 300B, and 300C according to other embodiments of the present disclosure are described below.

As illustrated in FIG. 2B, the fixing device 300A includes a pressing roller 390 on the opposite side of the pressure roller 320 pressing the fixing belt 310 and nips the fixing belt 310 between the pressing roller 390 and the heater 330 to heat the fixing belt 310.

An auxiliary stay 351 supports the heater 330, and the stay 350 supports the auxiliary stay 351. The auxiliary stay 351 is attached on one side of the stay 350, and a nip formation pad 381 is attached on the other side of the stay 350. The nip formation pad 381 contacts the pressure roller 320 via the fixing belt 310 to form the fixing nip SN.

As illustrated in FIG. 2C, the fixing device 300B omits the above-described pressing roller 390 and includes the heater 330 forming arc with a curvature of the fixing belt 310. The above-described arc shaped heater 330 increase a contact length in which the heater 330 is in contact with the fixing belt 310 along the belt rotation direction to improve heating efficiency. Other parts of the fixing device 300B are the same as those of the fixing device 300A in FIG. 2B.

As illustrated in FIG. 2D, the fixing device 300C includes belts 311 and 312 on both sides of the pressure roller 320. The heater 330, the heater holder 340, the stay 350, and the like are disposed inside a loop of the belt 311 on the left side of the pressure roller 320 in FIG. 2D, and the heater 330 is pressed against the pressure roller 320 via the belt 311. Inside the loop of the belt 312 on the right side of the pressure roller 320 in FIG. 2D, the nip formation pad 381 and the stay 352 are disposed. The nip formation pad 381 is pressed against the pressure roller 320 via the belt 312 to form the fixing nip SN.

Heater Configuration

The heater in the fixing device according to the present disclosure may have various types of configurations as illustrated in FIGS. 8A to 8F. In either type, the resistive heat generator 370 is formed on the substrate 341. The substrate 341 is an elongated thin metal plate member coated with an insulating material.

Single Type Resistive Heat Generator

Figure 8A:
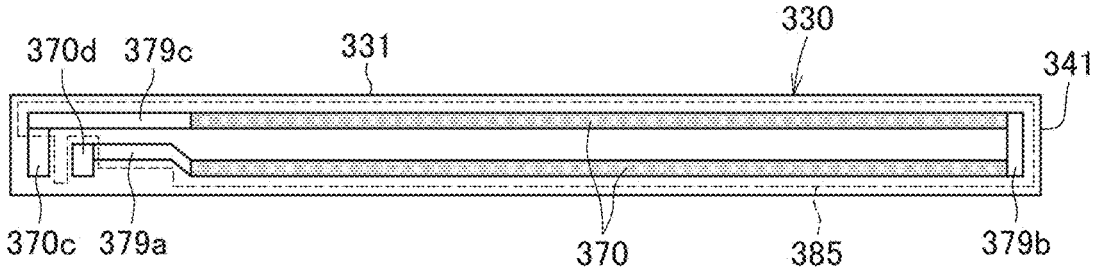
FIG. 8A is a plan view of a heater including electrodes at one end of the heater and a single type resistive heat generator.
Figure 8B:
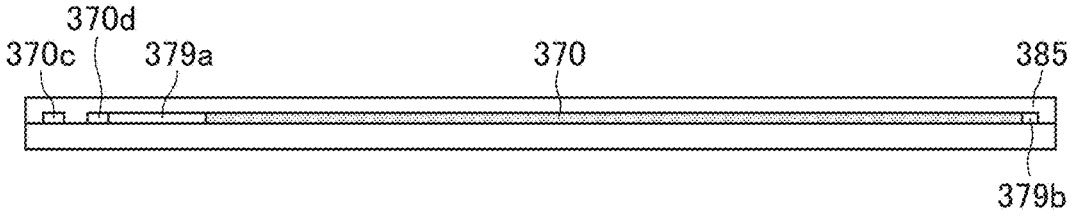
FIG. 8B is a sectional view of the heater of FIG. 8A including the single type resistive heat generator.

FIG. 8A is a plan view of the heater 330 including a single type resistive heat generator 370, and FIG. 8B is a side view of the heater 330 including a single type resistive heat generator 370. The resistive heat generator 370 is two parallel rows extending in the longitudinal direction of the substrate 341. On one end of the substrate 341, one ends of the two parallel rows of the resistive heat generator 370 are coupled to electrodes 370*c* and 370*d* via power supply lines 379*c* and 379*a*, respectively to supply power to the resistive heat generator 370. The power supply lines 379*a* and 379*c* extends in the longitudinal direction and each have a small resistance value. The electrodes 370*c* and 370*d* are coupled to a power supply such as an AC power source.

On the other end of the substrate 341, the other ends of the two parallel rows of the resistive heat generator 370 are coupled each other by a power supply line 379*b* having a small resistance value and extending in the short side direction of the substrate 341. As a result, the resistive heat generator 370 has a form turned back in the longitudinal direction of the substrate 341. The resistive heat generator 370, the electrodes 370*c* and 370*d*, and the power supply lines 379*a* to 379*c* are formed by, for example, screen-printing with a predetermined line width and thickness.

The surfaces of the resistive heat generator 370 and the power supply lines 379*a* to 379*c* are covered with a thin overcoat layer or an insulation layer 385. The insulation layer 385 secures the slidability with the fixing belt 310 and the insulation between the fixing belt 310 and the resistive heat generator 370 and the power supply lines 379*a* to 379*c*. The insulation layer 385 made of heat-resistant glass prevents the lubricant on the slide layer of the heater 330 from impregnating into the resistive heat generator 370 and thus prevents oil film shortage at the nip surface.

Dual Type Resistive Heat Generator

Figure 8C:
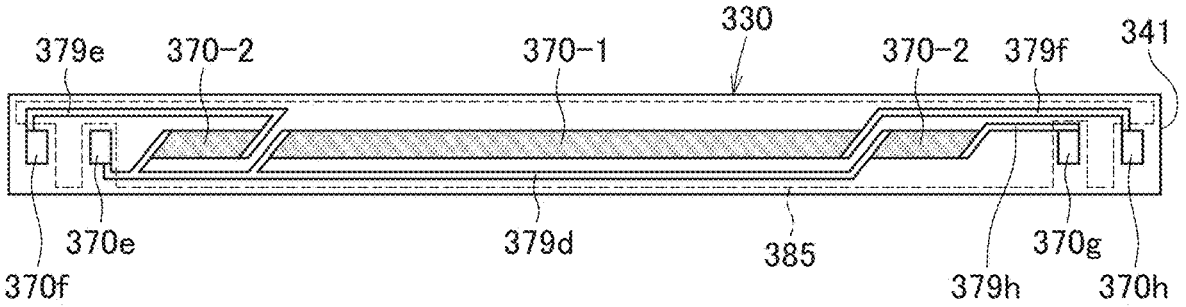
FIG. 8C is a plan view of a heater including electrodes at both ends of the heater and a dual type resistive heat generator.

FIG. 8C is a plan view of the heater 330 including a dual type resistive heat generator. The dual type resistive heat generator includes a central resistive heat generator 370-1 at the center in the longitudinal direction of the heater 330 and a pair of left and right end resistive heat generators 370-2 disposed on both sides of the central resistive heat generator 370-1. A shape of each of the central resistive heat generator 370-1 and the end resistive heat generators 370-2 is a parallelogram A side of the central resistive heat generator 370-1 and a side of the end resistive heat generator 370-2 that face each other are inclined with respect to the short side direction of the substrate 341. The inclined sides reduce a gap between the central resistive heat generator 370-1 and each of the end resistive heat generators 370-2 when viewed from the short side direction of the substrate 341 and decrease a temperature drop in the gap between the central resistive heat generator 370-1 and each of the end resistive heat generators 370-2.

As illustrated in FIG. 8C, one end of the central resistive heat generator 370-1 is coupled to the left electrode 370*e* via the power supply line 379*d*, and the other end of the central resistive heat generator 370-1 is coupled to the right electrode 370*h* via the power supply line 379*f*. In addition, one end of the left end resistive heat generator 370-2 is coupled to the left electrode 370*e* via the power supply line 379*d*, and the other end of the left end resistive heat generator 370-2 is coupled to the left electrode 370*f* via the power supply line 379*e*. One end of the right end resistive heat generator 370-2 is coupled to the left electrode 370*e* via the power supply line 379*d*, and the other end of the right end resistive heat generator 370-2 is coupled to the right electrode 370*g* via the power supply line 379*h*.

Coupling the resistive heat generators 370-1 and 370-2 to the electrodes 370*e* to 370*h* enables the central resistive heat generator 370-1 and the end resistive heat generators 370-2 to independently generate heat. Specifically, applying a voltage to the electrodes 370*e* and 370*h* causes the central resistive heat generator 370-1 to generate heat, applying the voltage to the electrodes 370*e* and 370*f* causes the left end resistive heat generator 370-2 to generate heat, and applying the voltage to the electrodes 370*e* and 370*g* causes the right end resistive heat generator 370-2 to generate heat.

Coupling the electrodes 370*f* and 370*g* in parallel outside the heater enables the left and right end resistive heat generators 370-2 to simultaneously generate heat. When the fixing device is configured to convey the sheet on the center of the fixing belt, the temperature distribution of the fixing belt is symmetrical with respect to the center in the right and left direction. Therefore, a thermistor may be disposed opposite one of the end resistive heat generators 370-2 without disposing two thermistors opposite end resistive heat generators 370-2 at both end portions of the substrate 341, thereby reducing the cost.

Multi-Type Resistive Heat Generator

Figure 8D:
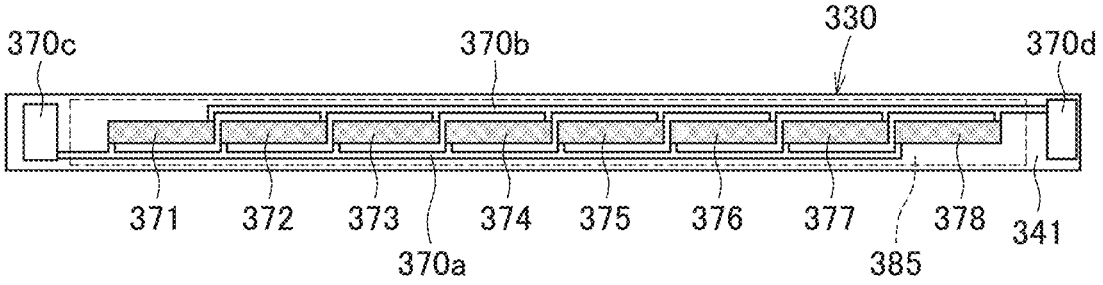
FIGS. 8D to 8F are plan views of heaters each including electrodes at both ends of the heater and a multi-type resistive heat generator.
Figure 8E:
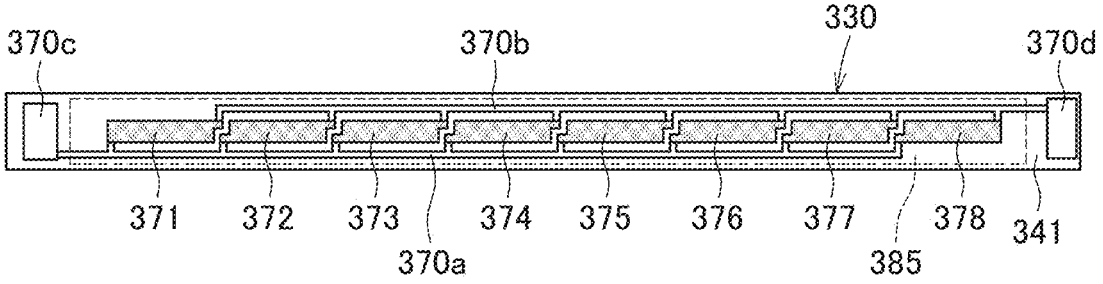
Figure 8F:
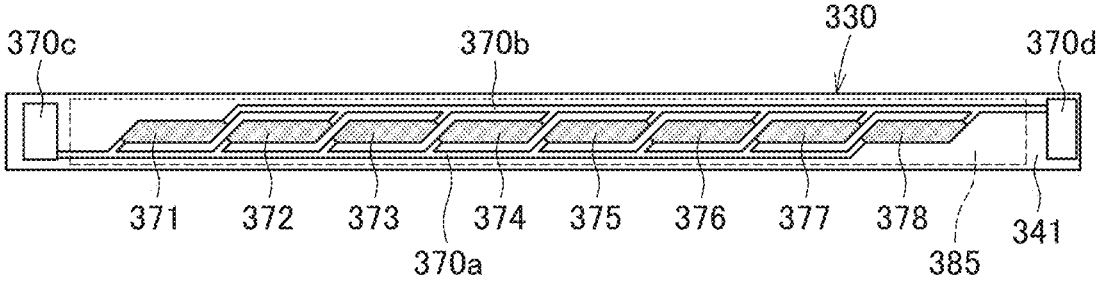

FIGS. 8D to 8F are plan views of heaters each including a multi-type resistive heat generator. The multi-type resistive heat generator includes a plurality of positive temperature coefficient (PTC) elements 371 to 378 electrically coupled in parallel. The PTC element is made of a material having a positive temperature resistance coefficient and has a characteristic that the resistance value increases as the temperature T increases. The temperature coefficient of resistance (TCR) may be, for example, 1500 parts per million (PPM). The multi-type resistive heat generator easily uniforms a temperature distribution in the longitudinal direction. The uniform temperature distribution reduces variation of viscosity of grease, which makes the amount of grease on the nip surface uniform in the longitudinal direction.

The PTC elements 371 to 378 are arranged linearly at equal intervals in the longitudinal direction of the substrate 341. On both sides of each of the PTC elements 371 to 378 in the short-side direction of the substrate 341, power supply lines 370*a* and 370*b* having small resistance values are linearly arranged in parallel to each other. Both ends of each of the PTC elements 371 to 378 are coupled to the power supply lines 370*a* and 370*b*. The PTC elements 371 to 378 are coupled to electrodes 370*c* and 370*d* disposed on both end sides of the heater 330 in the longitudinal direction via power supply lines 370*a* and 370*b*.

The PTC elements 371 to 378 may be formed by, for example, applying the paste prepared by mixing silver-palladium (AgPd), glass powder, or the like to the substrate 341 by screen printing or the like, and then firing the substrate 341. As the material of the PTC elements 371 to 378, a resistance material such as the silver alloy (AgPt) or ruthenium oxide ($RuO_2$) may be used in addition to the materials described above.

Use of the PTC elements 371 to 378 reduces an increase in temperature in the PTC element in which small sheets do not contact when the small sheets pass through the fixing device 300 because the relation of the PTC element (that is a resistance heating element) between resistance and temperature reduces heat generation amount in the PTC element in which the small sheets do not contact. For example, printing sheets smaller than a width corresponding to all PTC elements 371 to 378, for example, sheets having width corresponding to the PTC elements 373 to 376, raises temperatures in the PTC elements 371, 372, 377, and 378 disposed outside the sheets because the sheets do not draw heat from the PTC elements 371, 372, 377, and 378. Raising temperatures in the PTC elements 371, 372, 377, and 378 causes increase in resistance values of the PTC elements 371, 372, 377, and 378. Since a constant voltage is applied to the PTC elements 371 to 378, the increase in resistance values relatively reduces outputs of the PTC elements 371, 372, 377, and 378 disposed outside the width of the sheet, thus restraining an increase in temperature in end portions outside the sheets.

Unlike configurations illustrated in FIGS. 8D to 8F, the plurality of PTC elements 371 to 378 may be electrically coupled in series. However, the PTC elements 371 to 378 coupled in series needs to reduce a print speed to prevent the temperature rise in the resistive heat generator outside the width of the sheets in continuous printing small sheets. In contrast, electrically coupling the PTC elements 371 to 378 in parallel as illustrated in FIGS. 8D to 8F can restrain temperature rises in non-sheet passage portions while maintaining the print speed, which gives advantage that the productivity of printing can be maintained.

Typically, as the temperature increases, the strength of the fixing belt decreases. Therefore, the fixing belt 310 is likely to be worn. The multi-type resistive heat generator as illustrated in FIGS. 8D to 8F can prevent the excessive temperature rise in the non-sheet-passing portion even when small sheets pass through the fixing device. As a result, the wear of the fixing belt and evaporation of the lubricant are prevented.

The shape of each of the PTC elements 371 to 378 may be a shape having a step portion formed by an L-shaped notch at an end in the longitudinal direction as illustrated in FIG. 8E, or a parallelogram as illustrated in FIG. 8F in addition to a rectangle illustrated in FIG. 8D.

In FIG. 8E, the step portion is formed by the L-shaped notch at the end of each of the PTC elements 371 to 378, and the step portion overlaps with a step portion at an end of the adjacent PTC element. In FIG. 8F, an oblique cut-away inclination is formed at each of the ends of the PTC elements 371 to 378 so that the inclination overlaps the inclination of the end portion of the adjacent PTC element. Mutually overlapping the ends of the PTC elements 371 to 378 in this manner can restrain the influence of a decrease in heat generating amount in gaps between the PTC elements.

The electrodes 370*c* and 370*d* in each of the heaters 330 illustrated in FIGS. 8D to 8F are respectively disposed on both sides of the substrate 341 so as to sandwich the PTC elements 371 to 378, but the electrodes 370*c* and 370*d* may be disposed adjacent to one side of the PTC elements 371 to 378 on one end of the substrate 341. Disposing the electrodes 370*c* and 370*d* on one end of the substrate 341 can reduce the size of the heater 330 in the longitudinal direction.

The shape of each of the PTC elements 371 to 378 is not limited to a block shape (a rectangular shape, a parallelogram shape, or the like) as illustrated in FIGS. 8D to 8F and may be a meandering line shape to obtain a desired output (resistance value).

In the above-described embodiments, the present disclosure is applied to the fixing device that is an example of the belt device. The present disclosure may be applied to other belt devices. For example, in an inkjet type image forming apparatus, the belt device of the present disclosure may be applied to a drying device as the belt device that heats the sheet to dry an ink (that is liquid) on the sheet while the belt conveys the sheet.

In the above-described embodiments, the present disclosure is applied to prevent the occurrence of the abnormal noise at the sliding portion between the fixing belt and the heater as examples. However, the present disclosure is also applicable to the sliding portion between the nip formation pad 381 and the belt illustrated in FIG. 2C or FIG. 2D. In other words, the secured member of present disclosure may be various types of secured member on which the belt slides, such as the nip formation pad, in addition to the heater.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

What is claimed is:

1. A belt device comprising:

a secured member;

a belt having an endless shape and configured to slide on a slide surface of the secured member, the belt including an elastic layer and a base layer, the base layer having an elastic power of 55% or more, the base layer having a sliding surface configured to slide on the slide surface of the secured member, the sliding surface having a surface roughness smaller than a surface roughness of the slide surface of the secured member;

a pressure rotator configured to press the secured member via the belt to form a nip between the belt and the pressure rotator; and lubricant interposed between the sliding surface of the belt and the slide surface of the secured member.

2. The belt device according to claim 1, wherein the base layer has an elastic power of 62% or more.

3. The belt device according to claim 1, wherein the slide surface of the secured member has a surface roughness of 0.2 μm or more.

4. The belt device according to claim 1, wherein the slide surface of the secured member has a line roughness of 0.2 μm or more in a sliding direction.

5. The belt device according to claim 1, wherein the sliding surface of the belt has a surface roughness of 0.05 μm or less.

6. The belt device according to claim 1, wherein the sliding surface of the belt has a line roughness of 0.05 μm or less in a sliding direction.

7. The belt device according to claim 1, wherein the slide surface of the secured member has a valley void volume of 0.01 $ml/m^2$ or more.

8. The belt device according to claim 1, wherein the slide surface of the secured member has a skewness equal to or smaller than zero.

9. The belt device according to claim 1, wherein the slide surface of the secured member has a kurtosis smaller than three.

10. A fixing device comprising:

the belt device according to claim 1; and a heater configured to heat at least one of the belt in the belt device or the pressure rotator.

11. The fixing device according to claim 10, wherein the heater is the secured member on which an inner circumferential surface of the belt slides.

12. The fixing device according to claim 11, wherein the heater includes a plurality of heat generators arranged in a longitudinal direction of the heater, and wherein the plurality of heat generators is configured to independently generate heat.

13. An image forming apparatus comprising the fixing device according to claim 10.

14. The fixing device of claim 10, further comprising:

a pressing roller; and a pressure roller configured to nip the belt between the pressing roller and the heater.

15. The fixing device of claim 10, further comprising:

a stay configured to support the heater; and an auxiliary stay configured to support the stay.

16. An image forming apparatus comprising the belt device according to claim 1.

17. The belt device according to claim 1, wherein the belt comprises polyimide.

* * * * *